United States Patent [19]

Askelund et al.

[11] Patent Number: 4,905,958

[45] Date of Patent: Mar. 6, 1990

[54] BLOWOUT PREVENTER

[75] Inventors: Rune Askelund, Hundvag; Vidar Larsen, Kleppe, both of Norway

[73] Assignee: Peter Smedvig A/S, Stavanger, Norway

[21] Appl. No.: 282,128

[22] Filed: Dec. 6, 1988

[51] Int. Cl.[4] ..... F01L 1/04

[52] U.S. Cl. ..... 251/1.2; 166/73; 166/187

[58] Field of Search ..... 251/1.1, 1.2; 166/73, 166/86, 88, 187

[56] References Cited

U.S. PATENT DOCUMENTS 3,283,823 9/1963 Warrington .

FOREIGN PATENT DOCUMENTS 1378596 2/1972 United Kingdom .

*Primary Examiner*—John Fox

*Attorney, Agent, or Firm*—Wegner & Bretschneider

[57] ABSTRACT

A blowout preventer, particularly for use in drilling bore hole sections near the sea bed, is adapted to prevent blowout of shallow gas in the bore hole. It comprises at least one annular, preferably flexibly expansible and contractible packing element (59, 59'), which by radially directed expansion is adapted to rest sealingly against the wall of the bore hole and close the passage through the annular space of the bore hole. The blowout preventer comprises an inner sleeve element (1) being limited telescopingly displaceable in relation to the outer housing (8) of the blowout preventer and being spring loaded (9) towards extended telescopic position when it is not subjected to extra weight loading, and means which in the relative contracted telescopic position of the sleeve element (1) and outer housing (8) is adapted to close the passage through the inner cavity (48) of the blowout preventer and establish liquid connection to the packing element or elements (59, 59') for inflation thereof.

13 Claims, 9 Drawing Sheets

BLOWOUT PREVENTER

The present invention relates to a blowout preventer, particularly for use when drilling so-called top hole sections, i.e. bore hole sections near the seabed, and which is adapted to prevent blowout of shallow gas in the bore hole. The blowout preventer according to the invention is of the kind defined in the preamble of the appended claim 1.

When drilling top hole sections near the seabed one may encounter gas pockets containing shallow gas. When this happens, in accordance with conventional operating procedure, a diverter system will be used on the rig in order to draw off the gas through a pipe system. However, such an operation, i.a. entails a substantial explosion risk on board the rig.

In order to use a blowout preventer for avoiding blowouts of shallow gas in the bore hole when drilling said top hole sections, it is necessary to evaluate the geological conditions in a top hole section as regards the properties of the cap formation over sand layers containing shallow gas.

The blowout preventer according to the invention is primarily intended for use in preventing accidents that could occur when drilling through pockets containing shallow gas and thereby eliminate the risks associated with conducting a downhole gas inflow to the surface through the riser, the principle object of a blowout preventer according to the invention being to stop a gas inflow at the source.

It is previously known a number of various embodiments of blowout preventers. These all share the disadvantage that they have a relatively time consuming and complicated activating mechanism not providing the equipment with the necessary degree of reliability and safety.

In a known blowout preventer designed for use when drilling deep holes the releasing mechanism functions in accordance with the pressure differential principle. However, this known blowout preventer may not be used in so-called top hole sections because sufficient pressure differences across the blowout preventer cannot be obtained for activating its release mechanism. This prior art blowout preventer comprises an annular, elastically expansible and contractible packing element which in the active condition is intended to rest sealingly against the bore hole wall in order to prevent uncontrolled blowout of gas in the bore hole.

The purpose of the present invention is primarily to provide a blowout preventer of the kind defined in the introduction, which is well suited for use in so-called top hole sections. Besides, in accordance with the invention one has emphasized simple operation of the equipment and optimum reliability and safety during operation.

This object is achieved by designing the blowout preventer according to the invention in accordance with the features appearing from the characterizing part of claim 1.

The location of the blowout preventer in the drill string may be chosen quite freely along the entire length of the drill string below the drilling jar. Examples of suitable locations for such a blowout preventer could be just below or just above the lower stabilizer of the drill string.

An exemplifying embodiment of a blowout preventer according to the invention is described more closely below, reference being had to the appended drawings, where:

FIGS. 1*a*–1*e* show in side elevation/longitudinal section a general view of the entire blowout preventer in inactive standby position (initial position);

Figure 1A:
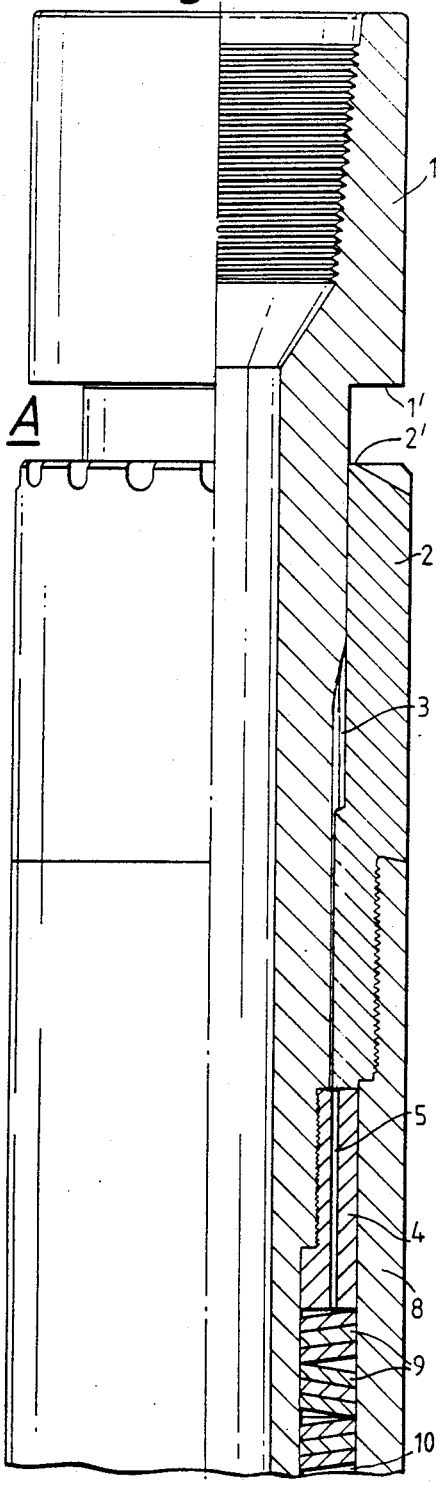
Figure 1B:
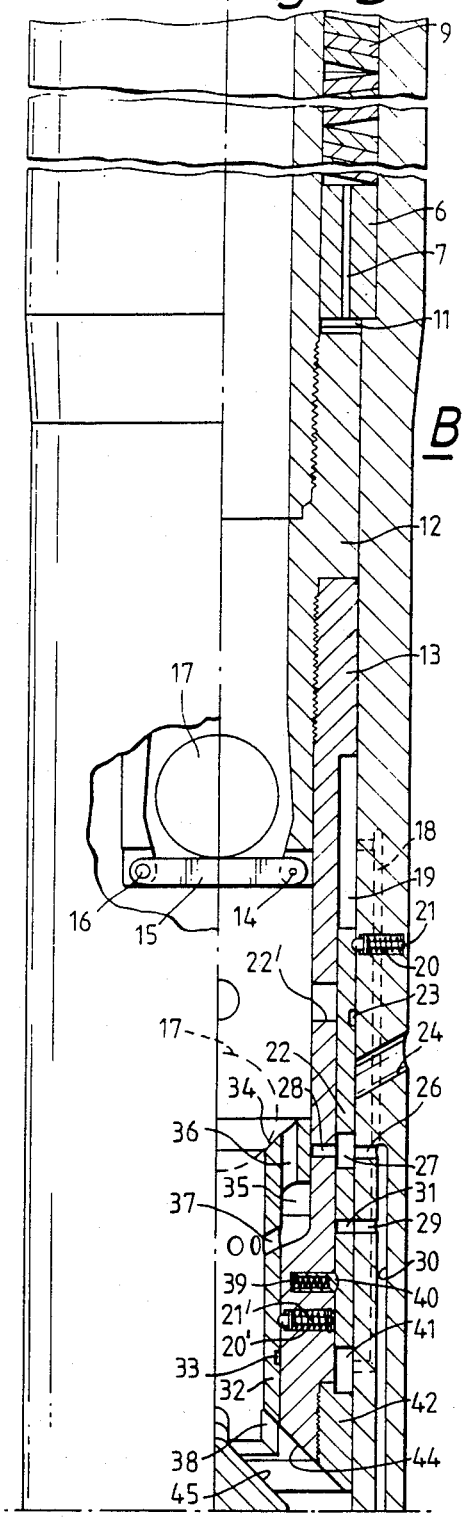
Figure 1C:
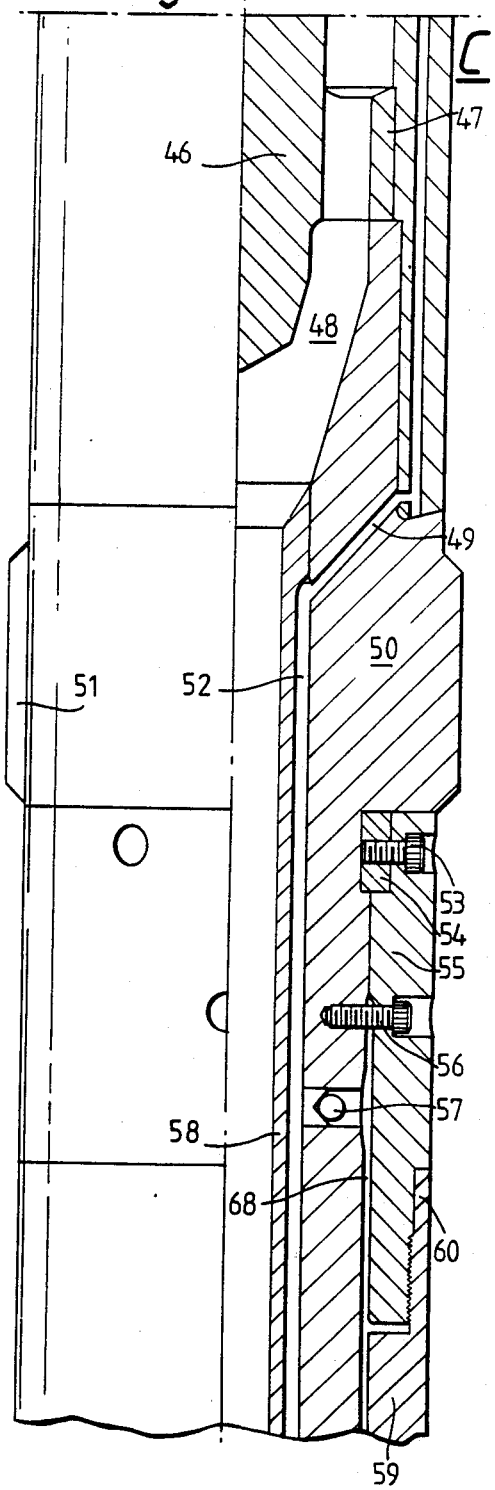
Figure 1D:
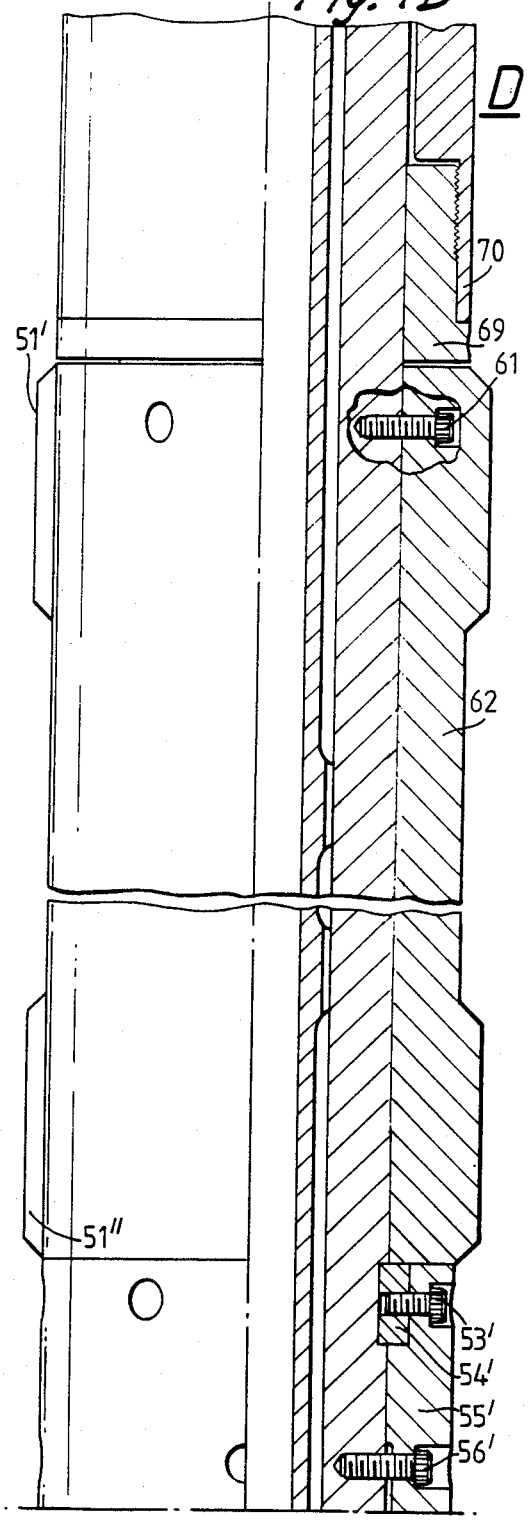
Figure 1E:
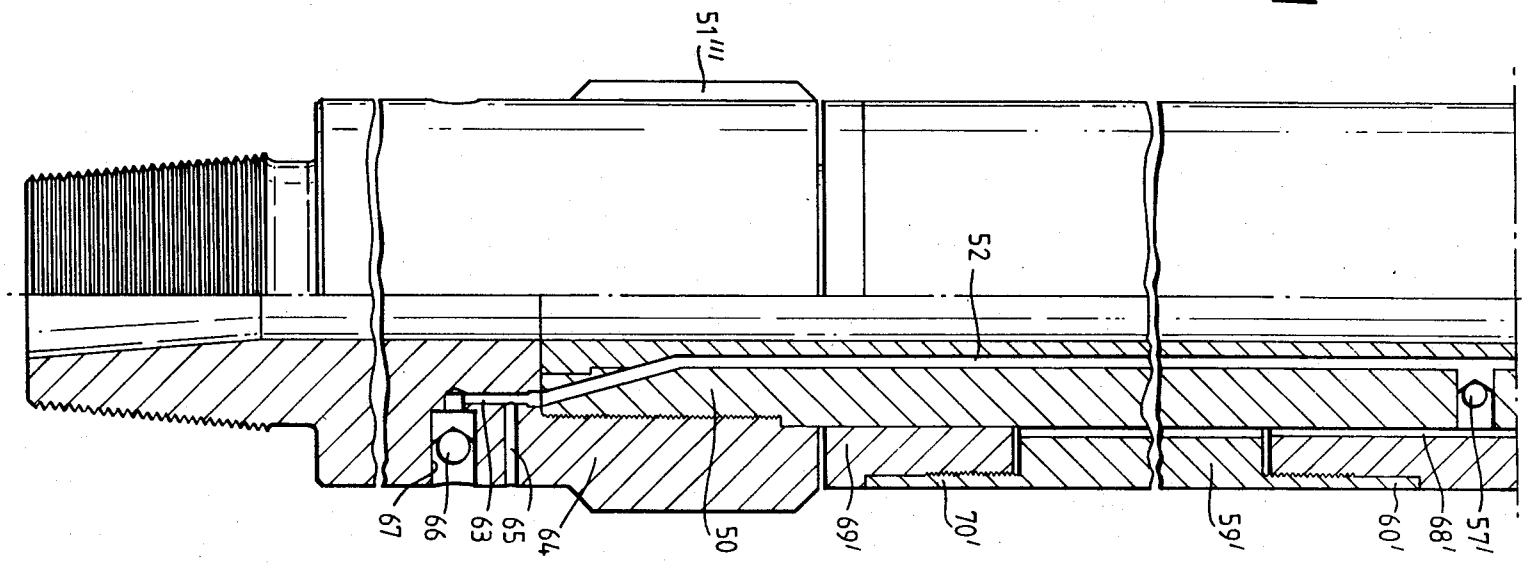

When it is referred to the appended drawings below, the terms "upper", "lower", "above", "below" etc. refer to the blowout preventer in its substantially vertical position of use. "Inner", "outer", "inside", "outside" etc. refer to the relative position of the various parts in the radial direction with respect to the longitudinal axis of the blowout preventer (drill string).

The blowout preventer shown in the drawings comprises (starting from above in the vertical position of use) an inner telescopic sleeve 1 and a concentric and cooperating outer telescopic sleeve 2.

Figure 2:
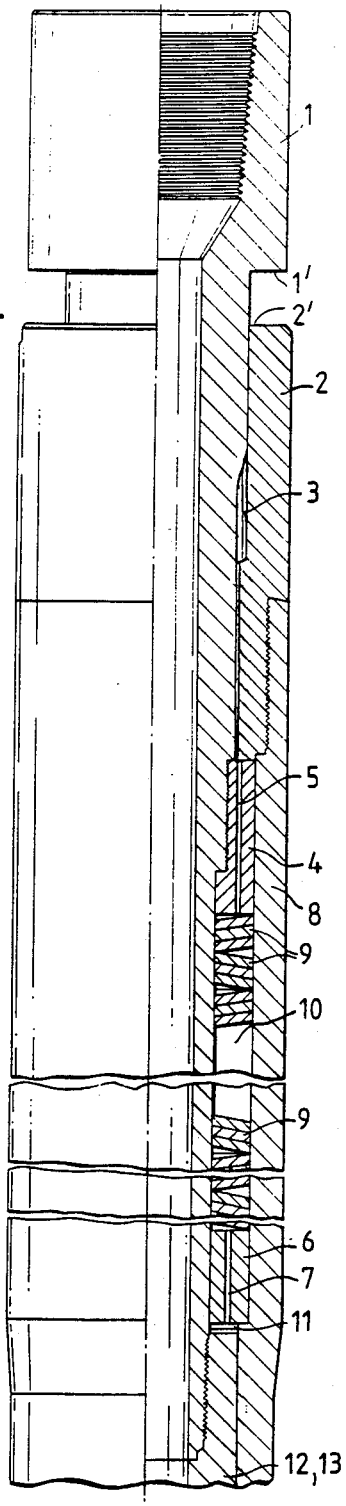
FIG. 2 shows on a larger scale a side elevation/ longitudinal section of the upper portion of the blowout preventer according to FIG. 1 in inactive standby position.
Figure 3:
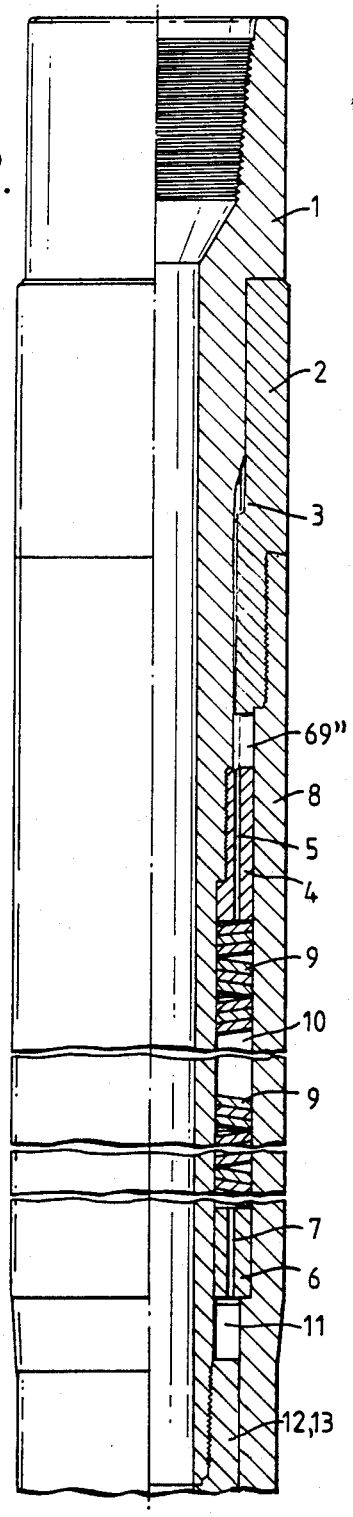
FIGS. 3–13 show, on the same scale as FIG. 2, longitudinal sections through the right half of different longitudinal portions of the blowout preventer according to FIG. 1, the various movable parts of the blowout preventer being shown in mutually different positions for starting different operations to be described below with particular reference to the different figures.
Figure 4:
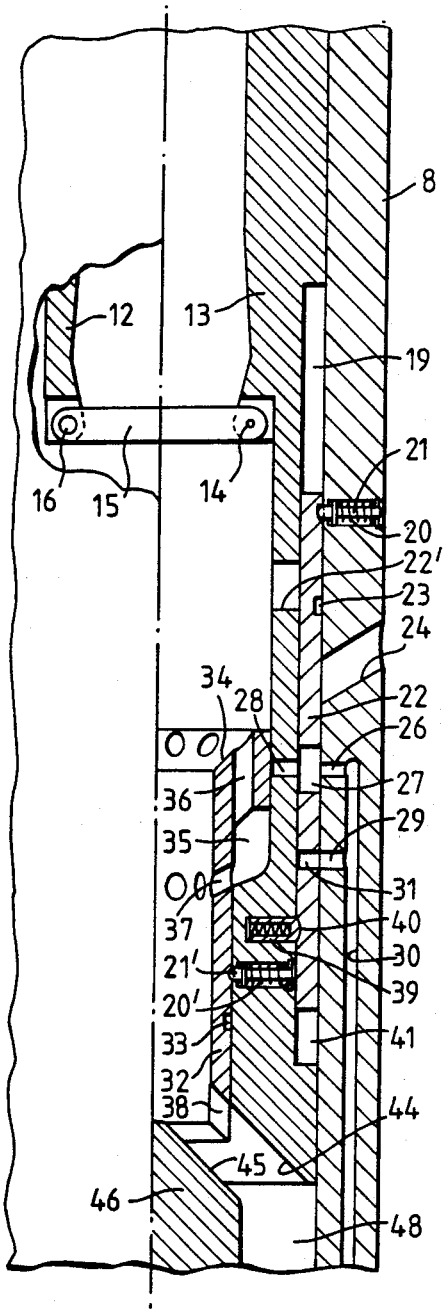

The two co-operating telescopic sleeves 1 and 2 have two extreme relative positions, viz. an extended telescopic position, see FIGS. 1 and 2, and a contracted telescopic position, see FIG. 3, where a bottom stop face 1' on the inner telescopic sleeve 1 rests against the upper end face 2' of the outer telescopic sleeve 2. The co-operating faces 1' and 2' limit the movement of the inner telescopic sleeve 1 relative to the outer telescopic sleeve 2, which is rigidly connected to the cylindrical outer housing 8 of the blowout preventer, e.g. by screw threads.

Co-operating axial grooves and teeth 3 on the outer and inner telescopic sleeves 2 and 1, respectively, prevent relative rotation of the sleeves but permit relative axial telescopic translation movement.

Between a stop ring 4, which has an axial pressure equalizing duct 5 and is screwed to the inner telescopic sleeve 1, and a spacer ring 6, which also has a throughgoing duct 7 and interengages with the cylindrical outer housing 8 of the blowout preventer such that the spacer ring 6 cannot move downwards with respect to the outer housing 8, a cup spring 9 is placed in compression in a space 10 between the inner telescopic sleeve 1 and the outer housing 8. The space is filled with grease, which, upon compression of the spring 9, may escape through the duct 7 in the spacer ring 6 to an annular space 11 below. During normal weight loading of the inner telescopic sleeve 1 and its interconnected parts, for instance during drilling, the cup spring 9 will keep the telescopic sleeves 1, 2 in the extended telescopic position (inactive standby position) as shown in FIGS. 1 and 2.

Nears its lower end the inner telescopic sleeve 1 carries a rigidly connected, radially external transition sleeve 12, which in turn is fixedly connected to an activating sleeve 13 extending downwards from the transition sleeve 12.

At its lower end the transition sleeve 12 carries a transverse shear pin 14 for a locking arm 15, which is pivotably supported at its opposite end by means of a hinge pin 16 carried by the transition sleeve 12. The locking arm 15 serves as temporary supporting means for a ball 17, to be described later in more detail together with the mechanism 14–16.

Reference numeral 18 designates a pressure equalizing duct, while 19 designates an upper annular space delimited between the activating sleeve 13 and the outer housing 8 of the blowout preventer. A spring loaded 20 holding pin 21 in the outer housing 8 is intended for releasable engagement with a sleeve-like valve slide 22, which in addition to the groove with which the holding pin 21 is engaged, as shown in FIG. 1, has a further locking groove 23 for engagement with the locking pin 21 during one of the operations of the blowout preventer, as will be described more closely later.

Radially outside the valve slide 22 the outer housing 8 has circulation ports 24. Reference numeral 26 designates an upper filling port in the outer housing 8, while 27 designates a slide port in the valve slide 22. 28 designates a filling port in the activating sleeve 13. 29 is a lower filling port in the outer housing 8, and 30 is an axial filling duct therein. This axial filling duct 30 is intended for conducting drilling mud to the packing element or elements of the blowout preventer for inflating the elements in case of a gas blowout in the bore hole. 31 is a filling port in the valve slide 22.

A seat sleeve 32 for the ball 17 is held releasably to the activating sleeve 13 by means of a spring loaded 20' holding pin 21' in a manner corresponding to the connection between the valve slide 22 and the outer housing 8 at (20,21), the seat sleeve 32 likewise being provided with a further locking groove 33 for later engagement with the holding pin 21' of the activating sleeve 13.

The seat sleeve 32 has an upper seat 34 for the ball 17 and is furthermore provided with an outer annular space 35, axial circulation ports 36 and outlet ports 37 connecting the annular space 35 with the inner bore of the seat sleeve 32. The lower end of the seat sleeve 32 is provided with circulation ports 38.

The activating sleeve 13 is in engagement with the valve slide 22 by means of a spring loaded locking pin 39, which is supported in the activating sleeve 13 and engages in a holding groove 40 in the valve slide 22.

Reference numeral 41 designates a lower annular space defined between the activating sleeve 13 and the outer housing 8 of the blowout preventer.

The lower end of the activating sleeve 13 is provided with a guide nut 42 screwed thereon. According to FIG. 1 the seat sleeve 32, the activating sleeve 13 and the guide nut 42 have aligned downwardly facing conical abutment faces, the abutment face of the activating sleeve 13 being designating 44. During some of the operations of the blowout preventer these conical abutment faces 44 are arranged to co-operate with a corresponding upwards facing conical abutment face 45 on a valve stopper 46, which is fixed to the outer housing 8 by means of holding means 47 ascertaining liquid flow centrally through the blowout preventer in the area of the valve stopper 46 when the abutment faces 44 and 45 are located spaced apart in accordance with FIG. 1. Here, reference numeral 48 designates the flow duct (inner cavity) through the blowout preventer past the valve stopper 46.

From the lower end of the filling duct 30 of the outer housing 8 a filling channel 49 leads at an angle downwards through a force transmitting sleeve 50, which is fixedly connected to the outer housing 8. 51-51''' designate outer protecting ribs.

An axial annular duct 52 defined between the force transmitting sleeve 50 and a radially inner sleeve 58 leads from the angled duct 49.

53 is a connecting screw for a locking ring 54 for locking the force transmitting sleeve 50 to an upper steel sleeve 55. 56 is a shear pin connecting the force transmitting sleeve 50 and the upper steel sleeve 55, but which may be sheared off during an operation to be described later.

57 is a non-return valve in the force transmitting sleeve 50.

Reference numeral 68 designates the annular space radially inside an annular packing element 59 known per se, which is arranged with its active part in a space between the upper steel sleeve 55 and a lower steel sleeve 69. The packing element 59 is elastically deformable in a known manner and may expand and contract flexibly and lies in its expanded condition against the wall of the annular space of the bore hole surrounding the blowout preventer (not shown) for the purpose of preventing blowout of gas in the bore hole. In the contracted position, as shown in FIG. 1, the radially outer delimiting surface of the packing element 59 lies radially inside the radially outer limit for the upper part of the blowout preventer, and the passage through said annular space of the bore hole is therefore open. The packing element 59 has an attachment flange 60', 70' for peripheral attachment to the steel sleeves 55, 69.

61 is a locking screw for locking a spacer sleeve 62 lying axially below the packing element 59. Below this spacer sleeve 62 follows a packing element 59' coupled in series to the packing element 59. Parts belonging to or connected to the packing device where the second packing element 59' is included and corresponding to structurally and functionally identical parts of the first packing device are designated with the same reference numerals plus an index, i.e. 53', 54', 56', 57', 60', 68', 69' and 70'.

At its lower end, below the second packing element 59', the duct 52 opens into a pressure limiting duct 63 in a lower sleeve body 64 attached to the force transmitting sleeve 50. Furthermore, the sleeve body 64 has a leakage bleed duct 65 and a non-return valve 66 provided with a port 67, which both communicate with the annular duct 52.

The blowout preventer shown and described functions in the following manner:

The blowout preventer is included in the drill string as mentioned in the introduction. During drilling in a so-called top hole section the drill bit is weight loaded by e.g. 5 tons. Under such a downwardly directed pressure the mutually telescopingly movable parts, for instance the inner telescopic sleeve 1 and the activating sleeve 12, 13 on the one side and for instance the outer telescopic sleeve 2 and the outer housing 8 on the other side, will be held in the inactive standby position/ initial position.

The position of the blowout preventer during drilling is therefore said extended telescopic position where the inner telescopic sleeve 1, the activating sleeve 12, 13 fixedly attached to the former, and the guide nut 42 fixed to the activating sleeve, are in their upper position. According to FIG. 1 the activating sleeve is formed as two separate sleeves screwed together, one of which being called transition sleeve 12, while the activating sleeve 12, 13 in FIGS. 3–13 are shown formed in one piece. If the technical assembling conditions permit, there is in principle nothing to prevent forming the activating sleeve 12, 13 in one piece with the inner telescopic sleeve 1.

During drilling with the parts in the position shown in FIGS. 1 and 2, drilling mud is pumped down through the inner space (represented by the flow duct 48 in the figures) of the blowout preventer and out through the drill bit. The seat sleeve 32 is held in locked position to the activating sleeve 12, 13 by means of the spring loaded 20' pin 21'. The valve slide 22 is locked to the outer housing 8 by means of the spring loaded 20 pin 21.

The liquid passage to the packing elements 59 and 59' through the axial filling duct 30 in the outer housing 8 is broken so that the packing elements 59, 59' are in the contracted, inactive position as shown in FIG. 1.

During drilling the ball 17 is not placed in the blowout preventer.

Spring loaded pins 21, 21' and 39 are arranged in one of two cooperating parts so as to be releasably engageable in a corresponding groove in an adjacent part, when the corresponding groove is aligned with one of the pins. A pin may be brought out of engagement with its corresponding groove when a relative translational force of a certain magnitude occurs between the parts. When the relative translational force is below this magnitude, the parts remain held together, i.e., the valve slide 22 is held to the outer housing 8, and the seat sleeve 32 is held to the activating sleeve 12, 13. When the engagement point of pin 39 has been moved downward so as to engage underneath the valve slide 22 (see FIG. 5), the upward translational movement of the activating sleeve 12, 13 will overcome the engagement of pin 21. An alternative groove has been formed in each of the respective cooperating parts for pins 21 and 21'. Therefore, the valve slide 2, in addition to the groove wherein pin 21 engages, has an alternative groove 23. Correspondingly, seat sleeve 32, in addition to the groove wherein pine 21' engages, has an alternative groove 33.

In order to activate the blowout preventer with the drill bit at the bottom of the drill hole, one proceeds as follows: The drill string is lowered until the drill bit is in contact with the bottom of the drill hole. Next an additional weight, for instance additionally 25 tons, is transmitted from the drill string to the upper, inner telescopic part 1 of the blowout preventer, thus forcing this part down towards the outer telescopic part 2 until the stop surface 1' abuts against the upper face of the outer telescopic sleeve 2, FIG. 3, so that the cup spring 9 is compressed. In order to control the compressing speed, grease is pressed from the annular space 10 of the spring 9 through the duct 7 in the spacer ring 6 to the ring space 11, which increases in volume during the compression of the parts 1, 2. Also the volume of the annular space 69'' between the outer telescopic sleeve 2 and the stop ring 4 increases during said compression.

The activating sleeve 12, 13, which is screwed to the inner telescopic sleeve 1, follows the downward movement of the latter. This causes the seat sleeve 32, which is fixedly attached to the activating sleeve 12, 13 via the pin 21', to move downwards from the position shown in FIG. 4 until its lower end abuts against the conical abutment face 45 on the valve stopper 46. When contact has been established between the seat sleeve 32 and the valve stopper 46, FIG. 5, the relative translation force between the seat sleeve 32 and activating sleeve 12, 13 is presumed to be of such a magnitude that the snap action of the spring loaded 20' pin 21' is overcome, whereupon the activating sleeve 12, 13 may move downwards with respect to the seat sleeve 32. Thus, the lower conical abutment face 44 of the activating sleeve 12, 13 is brought in contact with the corresponding abutment face 45 on the valve stopper 46. In this position, FIG. 5, the pin 21' engages in the locking groove 33 of the seat sleeve 32.

Figure 5:
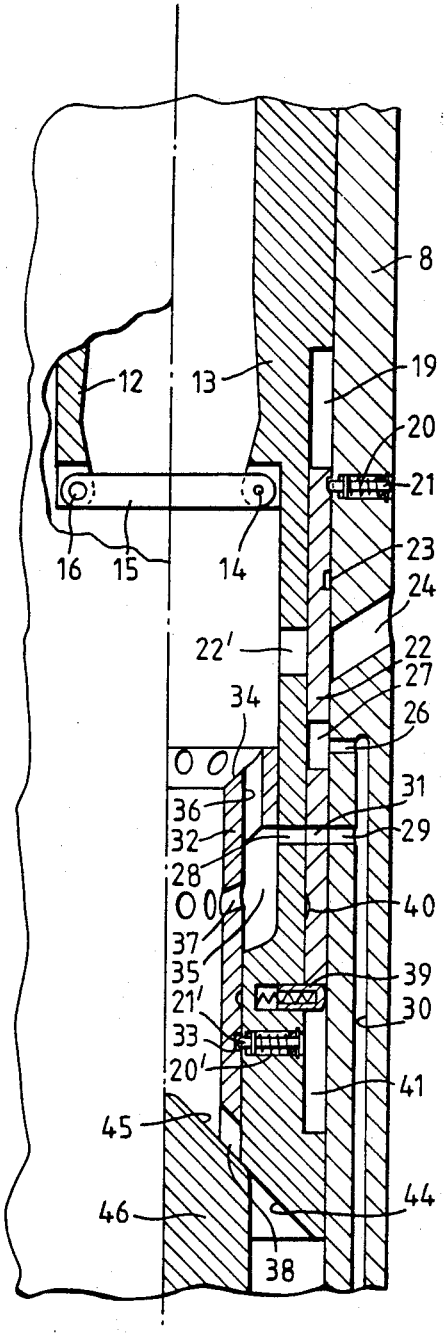

In the position shown in FIG. 5, the co-operating abutment faces 44, 45 of the activating sleeve 12, 13 and valve stopper 46 close the passage through the inner space 48 of the blowout preventer. Concurrently, a liquid communication from the inner space 48 of the blowout preventer to the duct 30 leading to the packing elements 59, 59' is provided, viz. through the circulation port 36 and the annular space 35 in the seat sleeve 32, the filling port 28 in the activating sleeve 12, 13, the filling port 31 in the valve slide 22 and the lower filling port 29 in the outer housing 8. From the duct 30 communication is provided to the packing elements 59, 59' via the ducts 49, 52, 57, 68 for inflating the packing elements in the activated condition of the blowout preventer. Drilling mud is now pumped into the packing elements 59, 59', the non-return valves 57, 57' maintaining the drilling mud pressure inside the packing elements 59, 59'.

When one wants to communicate with or measure the pressure of the gas flowing into the bore hole one proceeds as follows: From the position shown in FIG. 5 the drill string is lifted so that the telescope is extended and the parts assume the position shown in FIG. 6.

During the upward movement of the activating sleeve 12, 13 the valve slide 22 is lifted by means of the spring loaded locking pin 39 relative to the outer housing 8 if the locking pin 21 comes out of engagement with the upper groove 71 of the slide during the translatory movement of the slide 22 until it comes to engagement with the lower locking groove 23 of the slide. The passage through the cavity 48 of the blowout preventer is now open and one can read the pressure at the drill bit. The situation is stable. One can now decide the weight of the drilling mud to be used for stopping the inflowing gas.

Figure 6:
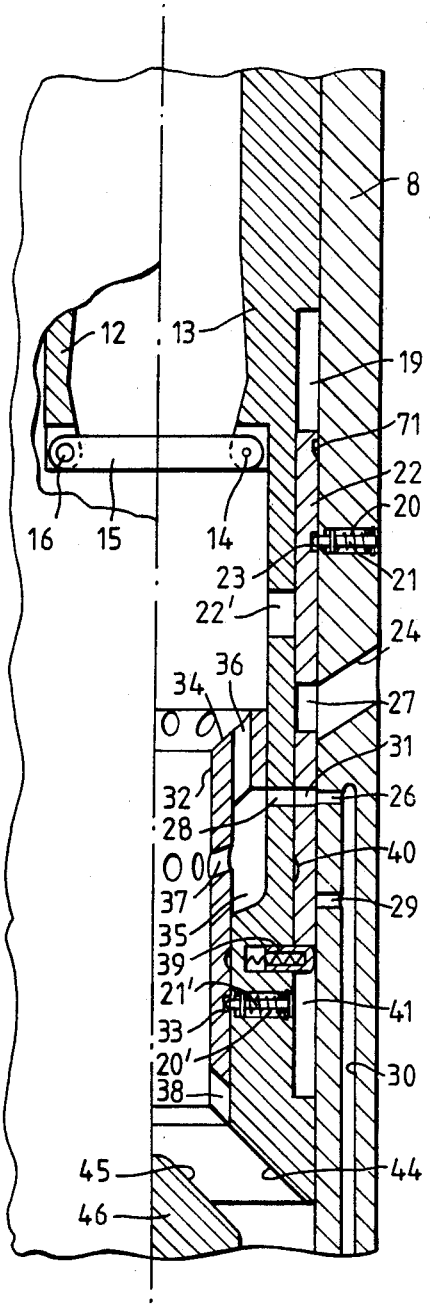

In this situation, FIG. 6, one may wish to circulate heave drilling mud down into the annular space of the bore hole above the packing elements 59, 59' in order to regain the stability of the bore hole. The telescope is compressed, thus bringing the conical abutment face 44 on the activating sleeve 12, 13 into engagement with the conical abutment face 45 on the valve stopper 46 so that the passage through the inner space 48 of the blowout preventer is closed, FIG. 7.

The part of the inner space 48 of the blowout preventer located above the abutment faces 44, 45 on the activating sleeve 12, 13 and valve stopper 46, respectively, in this position is in communication with the annular space of the bore hole outside the blowout preventer via the ports 22', 27 and 24 in the activating sleeve 12, 13, the valve slide 22 and the outer housing 8, respectively.

Figure 7:
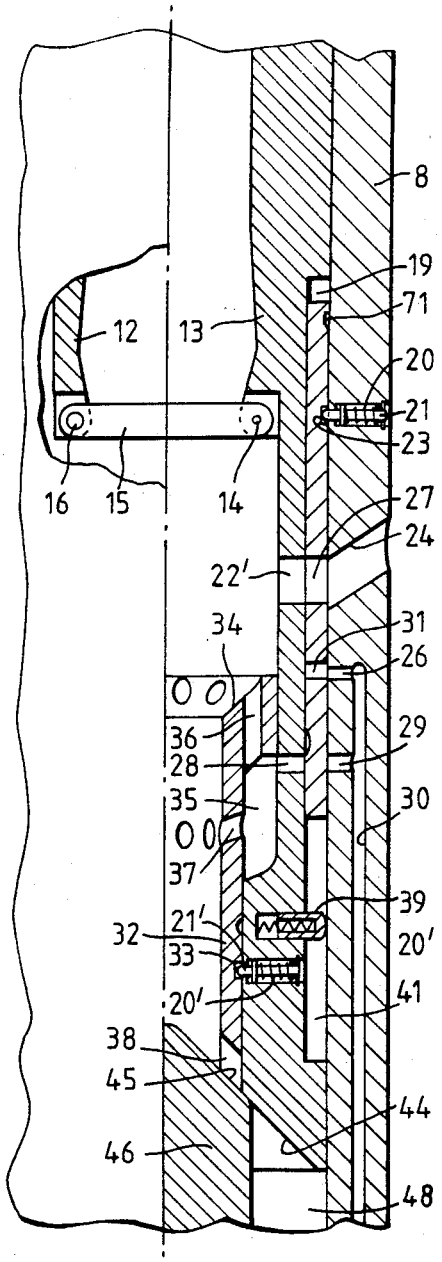

Heavy drilling mud may now be pumped into the annular space of the bore hole and thereafter up to the surface, FIG. 7. By repeated extensions/compressions of the telescope one can choose to communicate with the bottom of the bore hole via the inner space 48 of the blowout preventer or pump drilling mud out into the annular space by lifting or lowering the drill string, respectively, FIGS. 6 and 7. In the upper position, FIG. 6, one may, if desirable, also pump heavy drilling mud (below the packing elements 59, 59') via the drill bit in order to oppose/ close the gas inflow. In this position one may also guide the unwanted gas inflow via the inner space 48 to the surface, where the gas may for instance be burned or diverted. One does now have control of the situation.

When the blowout has been stopped, the blowout preventer should be withdrawn. One subjects the drill string to a torque and this torque is transmitted to the shear pins 56, 56' because the packing elements 59, 59' are pressed against the bore hole wall. The shear pins 56, 56' are sheared and their outer part is pressed out by the hydraulic pressure prevailing radially inside the packing elements 59, 59', which then go back to their inactive, contracted condition, FIG. 1. The drill string with the blowout preventer may now be pulled up to the surface.

Closing the blowout preventer when the drill bit does not rest against the bottom of the bore hole, takes place as follows: The initial situation is FIG. 4.

Figure 8:
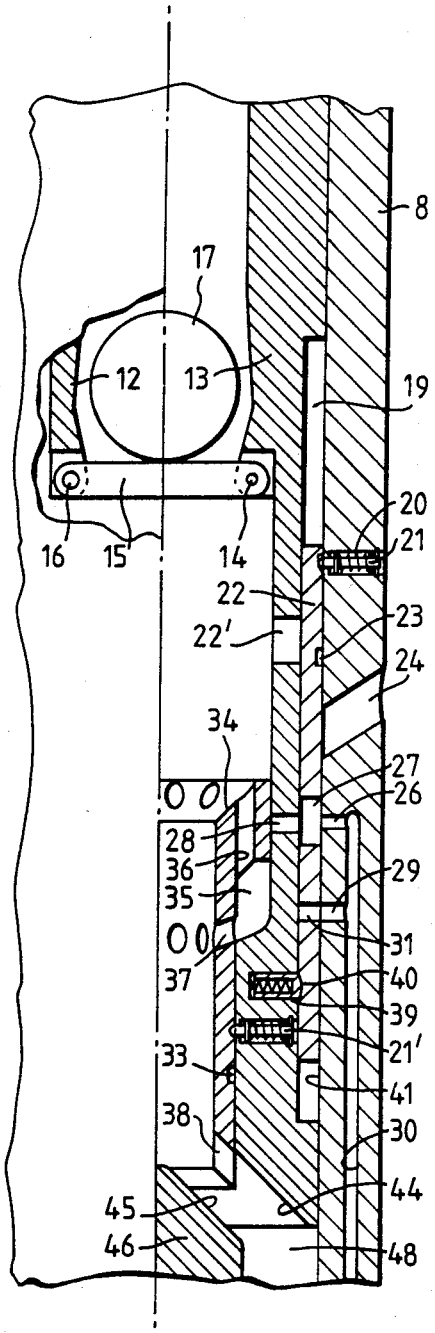
Figure 9:
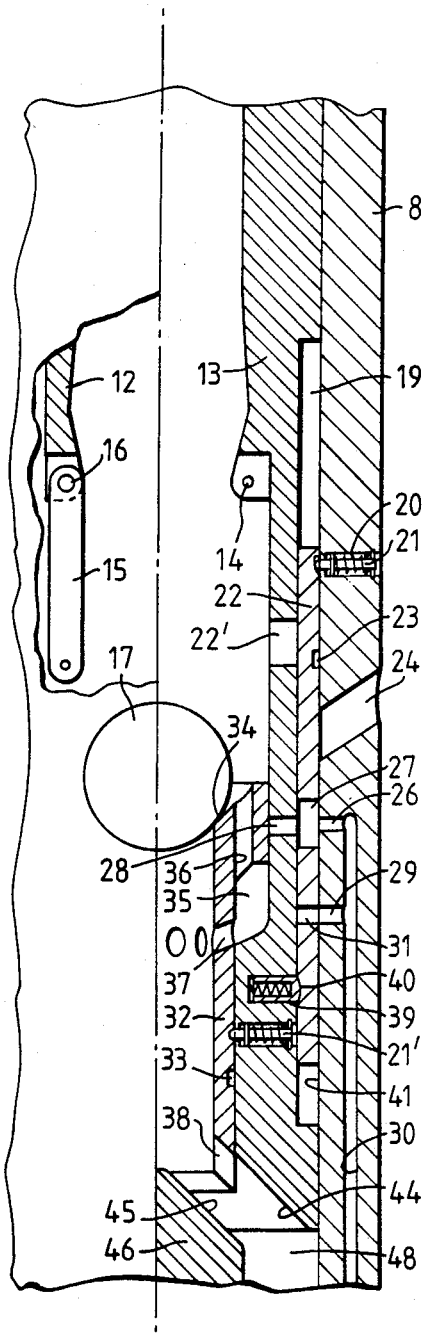
Figure 10:
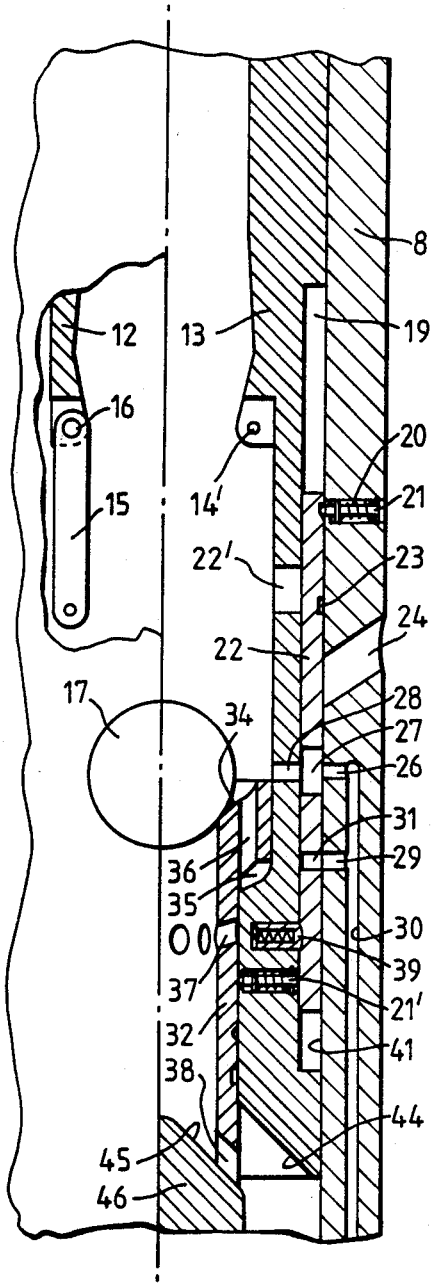

The ball 17 is dropped from the drill floor through the drill string until it is stopped by the locking arm 15, FIG. 8. This locking arm 15 is supported in the activating sleeve 12, 13; at one end by means of a hinge pin 16 and at the other end by means of a shear pin 14.

Drilling mud is then pumped down through the drill string and blowout preventer past the ball 17. The drilling mud pressure above the ball 17 is increased until the shear pin 14 breaks and the locking arm 15 swings downwards, FIG. 9. The ball 17 falls down to the conical seat 34 of the seat sleeve 32 and through its weight pushes the seat sleeve 32 downwards against the valve stopper 46 so that the flow through the ports 36, 35 and 37 is stopped, FIG. 10. Concurrently, liquid communication from the inner cavity 48 of the blowout preventer and the axial filling duct 30 of the outer housing 8 is established via the ports 28, 27 and 26 in the activating sleeve 12, 13, the valve slide 22 and the outer housing 8, respectively, so that the packing elements 59, 59' are inflated. The sequence is the repeated as mentioned above.

The contact of the packing elements 59, 59' with the bore hole wall permits transmission of weight, i.e. the packing elements hold the blowout preventer in position in the bore hole.

Figure 11:
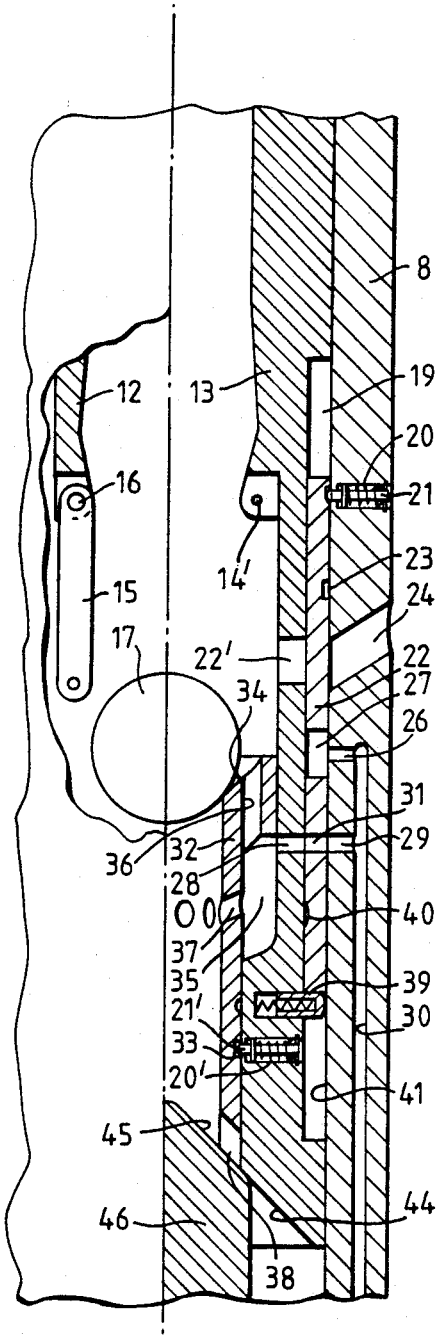

Next one compresses the telescope, FIG. 11, whereupon the the flow duct 48 of the blowout preventer is closed concurrently with establishing liquid connection to the filling duct 30 for the packing elements 59, 59' through the port 36 and the annular space 35 in the seat sleeve 32, the port 28 in the activating sleeve 12, 13, the port 31 in the valve slide 22 and the port 29 in the outer housing 8, whereupon the sequence above is repeated.

Figure 12:
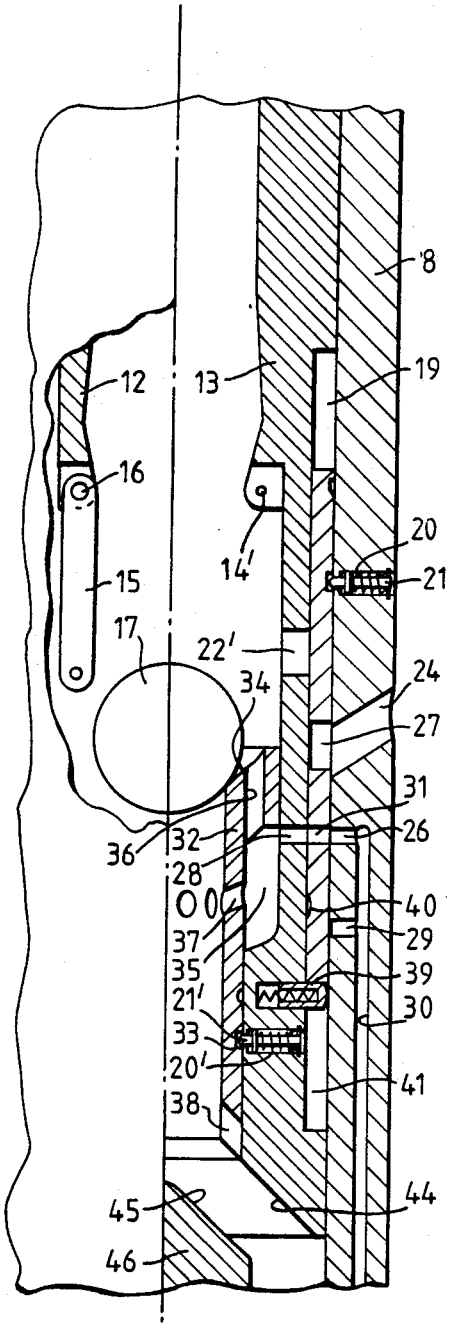
Figure 13:
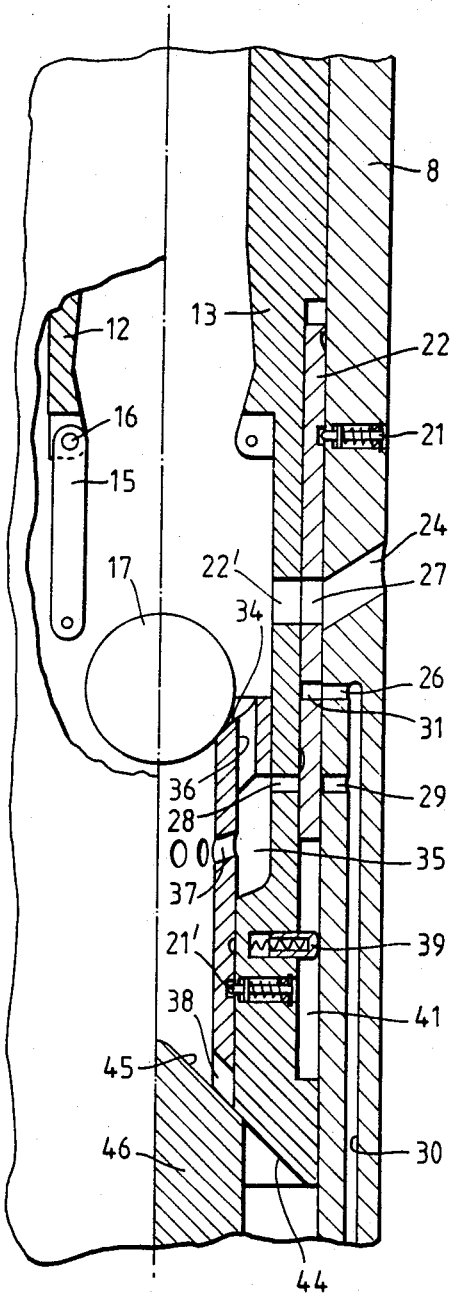

If one wants to communicate with the inflowing gas in this situation, the drill string is lifted as previously, FIG. 12. The upward flow can lift the ball 17 from the seat 34 or the flow can take place through the ports 37, 35 and 36 of the seat sleeve 32 for measuring pressure. In order to introduce heavy drilling mud in the annular space of the bore hole, weight is placed on the telescope as before, FIG. 13. The drill string is rotated for releasing as before.

We claim:

1. A blowout preventer for use in drilling bore hole sections near the seabed and which is adapted to prevent blowout of shallow gas in the bore hole sections, comprising:

at least one annular packing element which upon radial expansion is adapted to rest sealingly against the wall of the bore hole and thereby close passage through an annular space of the bore hole;

an inner sleeve element telescopingly displaceable in relation to an outer housing between an extended telescopic position and a contracted telescopic position, said inner sleeve element being spring biased toward said extended telescopic position;

an inner cavity; and a central element which is stationary with respect to said outer housing;

wherein said inner sleeve element comprises an actuating sleeve having at least one port;

wherein said outer housing is provided with at least one duct which communicates with said at least one annular packing element; and wherein when said inner sleeve is in said contracted telescopic position said actuating sleeve co-operates with said central element to block passage through said inner cavity and said at least one port communicates with said at least one duct to allow inflation of said at least one annular packing element.

2. A blowout preventer as claimed in claim 1, wherein said at least one annular packing element is flexibly expandable and contractable.

3. A blowout preventer as claimed in claim 1, further comprising an outer sleeve element fixedly connected to said outer housing and having an upper end surface, wherein said inner sleeve element is provided with a downwardly facing shoulder, and wherein said upper end surface rests against said downwardly facing shoulder when said inner sleeve is in said contracted telescopic position.

4. A blowout preventer as claimed in claim 3, wherein said inner sleeve element and said outer sleeve element are provided with intermeshing means for preventing relative rotational movement while allowing axial displacement.

5. A blowout preventer as claimed in claim 4, wherein said intermeshing means comprise elongate axial teeth.

6. A blowout preventer as claimed in claim 1, wherein said activating sleeve is provided with at least one secondary port, wherein said outer housing is provided with at least one secondary duct, and wherein when said inner sleeve is in said contracted telescopic position, said secondary port communicates with said secondary duct to establish liquid connection between said inner cavity of the blowout preventer and the annular space of the bore hole.

7. A blowout preventer as claimed in claim 1, wherein a lower end portion of said activating sleeve comprises a concave conical abutment surface, and wherein said central element is provided with a convex conical abutment surface which cooperates with said concave conical abutment surface when said inner sleeve is in said contracted telescopic position.

8. A blowout preventer as claimed in claim 1, further comprising a valve slide disposed radially between said actuating sleeve and said outer housing, wherein said valve slide is provided with at least one port for communicating with said at least one port of said inner sleeve element and at least one secondary port for communicating with said at least one secondary port of said inner sleeve member, and wherein said valve slide is releasably connected to both said activating sleeve and said outer housing, so that in a first position said valve slide is held fixedly to said outer housing, in a second position said valve slide is held fixedly to said activating sleeve, and in a third position said valve slide is held fixedly to both said activating member and said outer housing.

9. A blowout preventer as claimed in claim 1, further comprising a seat sleeve disposed radially inside a lower end of said activating sleeve and having an upper seat means for communicating with a body which is to weight load said inner sleeve element with said activating sleeve when a drill bit does not form an abutment by resting against the bottom of the bore hole, said seat sleeve being releasably connected to said activating sleeve so that in a first position said seat sleeve moves together with said activating sleeve and in a second position said seat sleeve can move in relation thereto, and wherein said seat sleeve is provided with at least one port which, when aligned, can communicate with said at least one port of said activating sleeve.

10. A blowout preventer as claimed in claim 9, wherein said upper seat means comprises a concave conical seat.

11. A blowout preventer as claimed in claim 9, wherein a lower end of said seat sleeve is provided with at least one circulation port in the form of a relieved edge around which is formed a abutment face, wherein said central element is provided with an upper abutment surface, and wherein said abutment face cooperates with said upper abutment surface when said inner sleeve is in said contracted telescopic position.

12. A blowout preventer as claimed in claim 11, wherein said abutment face is concave and said abutment surface is convex.

13. A blowout preventer as claimed in claim 9, wherein said activating sleeve, at a distance above the upper end of the seat sleeve, is provided with supporting means for temporarily supporting the body, said supporting means being at one end connected to said activating sleeve by means of a hinge pin and at the opposite end by means of a shear pin.

* * * * *